US007728701B2

(12) United States Patent
Lin et al.

(10) Patent No.: US 7,728,701 B2
(45) Date of Patent: Jun. 1, 2010

(54) WAVEGUIDE-BASED MEMS TUNABLE FILTERS AND PHASE SHIFTERS

(75) Inventors: Liwei Lin, Castro Valley, CA (US); Firas Sammoura, Berkeley, CA (US)

(73) Assignee: Regents of the University of California, Oakland, CA (US)

( * ) Notice: Subject to any disclaimer, the term of this patent is extended or adjusted under 35 U.S.C. 154(b) by 169 days.

(21) Appl. No.: 11/452,114

(22) Filed: Jun. 12, 2006

(65) Prior Publication Data

US 2007/0287634 A1 Dec. 13, 2007

(51) Int. Cl.
*H01P 1/208* (2006.01)
*H01P 1/18* (2006.01)
*H01P 7/06* (2006.01)

(52) U.S. Cl. ..... 333/209; 333/233; 333/159

(58) Field of Classification Search ..... 333/157, 333/159, 164, 202, 208–210, 212, 233
See application file for complete search history.

(56) References Cited

U.S. PATENT DOCUMENTS 5,977,849 A * 11/1999 Hsing et al. ..... 333/232
6,111,484 A * 8/2000 Henningsson et al. ..... 333/231
7,068,129 B2 * 6/2006 Higgins et al. ..... 333/209

OTHER PUBLICATIONS

Sammoura et al., "A Micromachined W-Band Iris Filter", The 13th Internation Conference on Solid-State Sensors, Actuators and Microsystems, Seoul, Korea, Jun. 5-9, 2005, pp. 1067-1070.*

Mead, J.B. et al., "Millimeter-Wave Radars for Remotely Sensing Clouds and Precipitation", Proceedings of the IEEE, 1994, vol. 82(12), pp. 1891-1906.

Hunter, I.C. et al., "Electronically Tunable Microwave Bandpass Filters", IEEE Transactions on Microwave Theory and Techniques, 1982, vol. MMT-30(9), pp. 1354-1360.

(Continued)

*Primary Examiner*—Benny Lee
*Assistant Examiner*—Gerald Stevens
(74) *Attorney, Agent, or Firm*—Townsend and Townsend and Crew LLP

(57) ABSTRACT

An actively tunable waveguide-based iris filter having a first part including a first portion of a deformable iris filter cavity having an inlet and an outlet; a second part operatively coupled with the first part and including a second portion of the deformable iris filter cavity having a deformable membrane operatively coupled with the first portion of a deformable iris filter cavity; the first portion and the second portion together forming the deformable iris filter cavity of the tunable waveguide-based iris filter; and means for moving the deformable membrane, whereby movement of the deformable membrane changes the geometry of the deformable iris filter cavity for causing a change in the frequency of a signal being filtered by the filter. The tunable filter is fabricated using a MEMS-based process including a plastic micro embossing process and a gold electroplating process. Prototype filters were fabricated and measured with bandwidth of 4.05 GHz centered at 94.79 GHz with a minimum insertion loss of 2.37 dB and return loss better than 15 dB. A total of 2.59 GHz center frequency shift was achieved when membranes deflected from −50 μm to +150 μm.

13 Claims, 6 Drawing Sheets

OTHER PUBLICATIONS

Y. Liu et al., "Distributed MEMS Transmission Lines for Tunable Filter Applications", International Journal of RF and Microwave Computer-Aided Engineering, 2001, vol. 11(5), pp. 254-260.

Entesari, K. et al., "A 12-18-GHz Three-Pole RF MEMS Tunable Filter", IEEE Transactions on Microwave Theory and Techniques, Aug. 2005, vol. 53(8), pp. 2566-2571.

Entesari, K. et al., "A Differential 4-bit 6.5-10-GHz RF MEMS Tunable Filter", IEEE Transactions of Microwave Theory and Techniques, Mar. 2005, vol. 53(3), pp. 1103-1110.

Lee, S. et al., "Millimeter-Wave MEMS Tunable Low Pass Filter With Reconfigurable Series Inductors and Capacitive Shunt Switches", IEEE Microwave and Wireless Components Letters, 2005, vol. 14(10), pp. 691-693.

Robertson, S. et al., "Micromachined Self-Packaged W-Band Bandpass Filters", 1995 IEEE MTT-S International Microwave Symposium Digest, 1995, vol. 3, pp. 1543-1546.

Zuo, X. et al., "Development of High Frequency Ferrite Phase-Shifter", IEEE Transactions on Magnetics, Jul. 2001, vol. 37(4), pp. 2395-2397.

Shan, X. et al., "Mode-Matching Analysis of H-Plane Ferrite-Loaded Rectangular Waveguide Discontinuities", International Journal of RF & Microwave Computer-Aided Engineering, Jul. 2003, vol. 13(4), pp. 259-268.

Glance, "A Fast Low-Loss Low-Drive 14-GHz Microstrip p-i-n Phase Shifter", IEEE Transactions on Microwave Theory and Techniques, Jun. 1980, vol. MTT-28(6), pp. 699-671.

Hung, J. et al., "A Low-Loss Distributed 2-Bit W-Band MEMS Phase Shifter", 33rd European Microwave Conference, Munich, 2003, vol. 3, pp. 983-985.

Lakshminarayanan, B. et al., "Electronically Tunable Multi-Line TRL Using an Impedance Matched Multi-Bit MEMS Phase Shifter", IEEE Microwave and Wireless Components Letters, Feb. 2005, vol. 15(2), pp. 137-139.

* cited by examiner

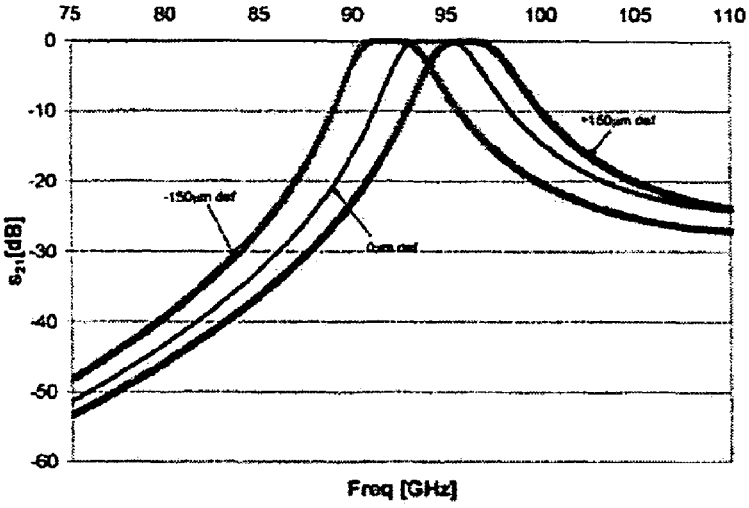
FIG. 3a
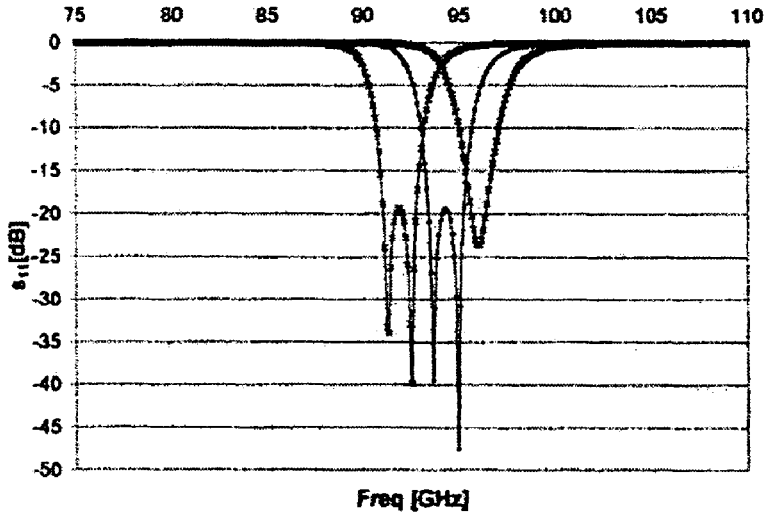
FIG. 3b
FIG. 3

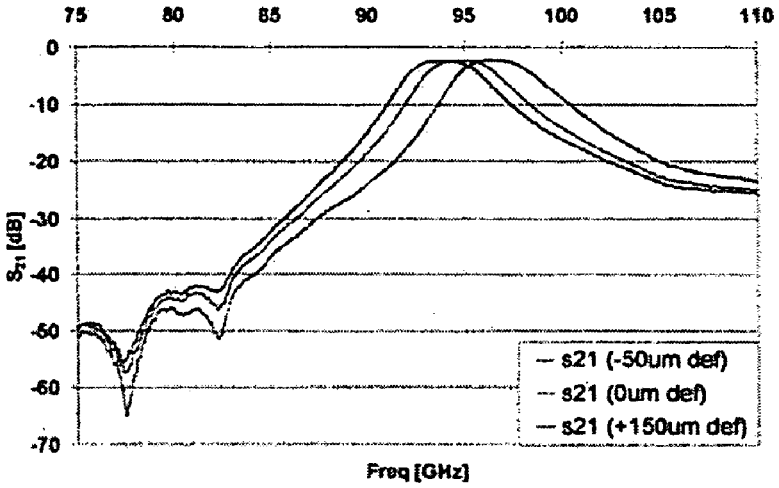
FIG. 6a
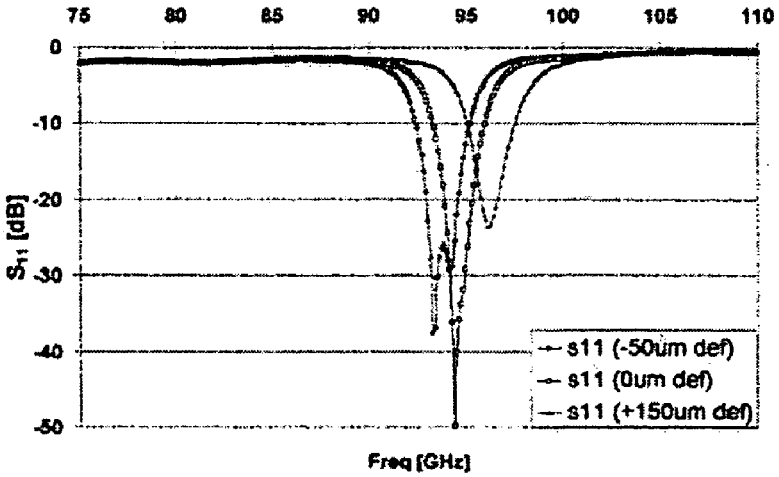
FIG. 6b
FIG. 6

WAVEGUIDE-BASED MEMS TUNABLE FILTERS AND PHASE SHIFTERS

STATEMENT AS TO RIGHTS TO INVENTIONS MADE UNDER FEDERALLY SPONSORED RESEARCH OR DEVELOPMENT

A part of this invention was made with Government support under an NSF Grant No. DMI-6428884. The Government has certain rights to this invention.

BACKGROUND OF THE INVENTION

The present invention relates to micro-electro-mechanical system (MEMS) tunable filters and phase shifters.

Millimeter-wave systems have been applied in various security and sensing systems, including weather monitoring, automobile crash avoidance, and airplane landing guidance (e.g., see J. B. Mead et al., *Proceedings of the IEEE,* 82(12): 1891-1906 (1994)). Tunable filters and phase shifters could play a key role in millimeter-wave applications, especially for multi-channel communication systems and electronically scanned antennas. Current methods for building tunable filters involve using solid-state varactors (e.g., see I. C. Hunter and J. D. Rhodes, *IEEE Transactions on Microwave Theory and Techniques*, vol. MMT-30(9):1354-1360 (1982)). However, there are major disadvantages to this approach, namely high losses, unacceptable signal-to-noise (SNR) ratio, and rendered linearity. Over the past decade, radio frequency micro-electro-mechanical systems (RF MEMS) provided a better alternative for building tunable filters, which are necessary for multi-band receivers. For example, MEMS varactors have been employed by some in order to realize a transmission line with voltage-variable electrical length. Tunable filters with a 3.8% tuning range at 20 GHz and a minimum insertion loss of 3.6 dB are known (Y. Liu et al., *International Journal of RF and Microwave Computer-Aided Engineering,* 11(5):254-260 (2001)). Entesari et al. presented wide-band tunable filters using a digital capacitor bank for 6.5~10 GHz and 12~18 GHz ranges with an insertion loss varying between 5.5 dB and 9 dB (e.g., see K. Entesari and G. Rebeiz, *IEEE Transactions on Microwave Theory and Techniques,* 53(8): 2566-2571 (August 2005); K. Entesari and G. Rebeiz, *IEEE Transactions of Microwave Theory and Techniques,* 53(3): 1103-1110 (March 2005)). A reconfigurable low-pass filter was reported by Lee et al. using multiple contact MEMS switches. The values of the inductors and capacitors were changed independently while the filter cutoff frequency dropped from 53 GHz to 20 GHz (e.g., see S. Lee et al. *IEEE Microwave and Wireless Components Letters,* 14(10):691-693 (2005)). Robertson et al. presented a micromachined W-band bandpass filter at 94.7 GHz without tuning capability (e.g., see S. Robertson et al., 1995 *IEEE MTT-S International Microwave Symposium Digest,* 3:1543-1546 (1995)).

Techniques for building phase shifters are known. For example, ferrite materials have been utilized to change the bias field and to induce time delay of the transmitting electromagnetic wave. Other approaches include the use of solid state devices such as microwave diodes and FETs to control and manipulate the phase (e.g., see G. Rebeiz, et al. *IEEE microwave magazine,* 72-81, (June 2002)). While ferrite-based phase shifters consume low power, their fabrication process suffers from difficulties. Diode-based phase shifters possess advantages in their small size, their compatibility with circuit integration, and their high operational speed but typically come with high signal losses. Zuo et al. demonstrated a ferrite phase shifter with a differential phase shift of 90°/KOe.mm at a frequency of 20 GHz and an insertion loss of 0.75 dB/mm (e.g., see X. Zuo, et al. *IEEE Transactions on Magnetics,* 37(4): 2395-2397, (July 2001)). Shan et al. reported a 90° nonreciprocal phase shifter at 12 GHz using an H-plane ferrite-slab loaded into a rectangular waveguide (e.g., see X. Shan, et al. *International Journal of RF & Microwave Computer-Aided Engineering,* 13(4): 259-68, (July 2003). Glance described a 14-GHz 4-bit p-i-n microstrip phase shifter with an insertion loss of 1.4 dB with a switching time of 1 nano second and switching power of 15 mW (e.g., see Glance, *IEEE Transactions on Microwave Theory and Techniques*, MTT-28(6): 699-671, (June 1980)). These efforts illustrate the importance of phase shifter development in scanned radar systems. Recently, MEMS technologies have been introduced to phase shifter design and implementation. MEMS technology could potentially offer low-loss and low-power consumption to solid-state phase shifters and a common scheme is to use MEMS switches to replace the solid-state switches. Hung et al. have developed a 2-bit wide band distributed MEMS transmission line phase shifter that can have discrete phase shifts of 0°, 89.3°, 180.1°, and 272° at 81 GHz with an average insertion loss of 2.2 dB (e.g., see J. Hung, et al., 33rd *European Microwave Conference*, vol. 3: 983-985, Munich (2003)). Lakshminarayanan et al. presented a scheme for an electronically tunable thru-reflect-line (TRL), using a 4-bit time delay MEMS phase shifter on coplanar waveguide (CPW) sections and reported a phase shift of 90°/mm at 50 GHz (e.g., see B. Lakshminarayanan, and T. Weller, *IEEE Microwave and Wireless Components Letters,* 15(2): 137-139, (February 2005)).

However, nearly all the known tunable filters and phase shifter are discrete devices and lack the required resolution to continuously cover the desired band of operation. Furthermore, they suffer from high insertion loss. There is therefore a need for a MEMS-based tunable filters and phase shifters that do not suffer from the above shortcomings.

BRIEF SUMMARY OF THE INVENTION

The present invention provides a novel dual usage actively tunable waveguide-based iris filter and phase shifter. The actively tunable device includes a first part including a first portion of a deformable iris filter cavity having an inlet and an outlet; a second part operatively coupled with the first part and including a second portion of the deformable iris filter cavity having a deformable membrane operatively coupled with the first portion of the deformable iris filter cavity; the first portion and the second portion together forming the deformable iris filter cavity of the tunable device; and means for moving the deformable membrane, whereby movement of the deformable membrane changes the geometry of the deformable iris filter cavity for causing a change in the frequency of a signal being filtered by the filter.

In one aspect, the deformable iris filter cavity is configured for causing a shift in the phase of a signal being filtered by the filter.

In one aspect, the tunable waveguide-based iris filter and phase shifter includes more than two operatively coupled cavities and deformable membranes.

In one aspect, the deformable membrane can be circular shaped, rectangular shaped, or polygonal shaped.

In another aspect, the one or more iris cavities have a rectangular cross section.

In one embodiment, the present invention provides a method for manufacturing a tunable iris filter and phase shifter. The method includes forming a first part including the first portion of one or more deformable iris filter cavities having an inlet and an outlet, by a plastic molding process; depositing a metallic seed layer on the internal surface of the first part; forming a second part for being operatively coupled with the first part by disposing a deformable membrane over an aperture in a substrate; depositing a metallic seed layer on the deformable membrane of the second part; assembling the first part with the second part such that the first part and the second part together form a deformable iris filter cavity of the tunable iris filter and phase shifter, and wherein the deformable membrane is dimensioned to fit into the first portion of the deformable iris filter cavity; selectively electroplating a metallic layer on the internal surfaces of the first part and the second part so as to seal and metallize the deformable iris filter cavity; and providing a means for moving the deformable membrane, whereby movement of the deformable membrane changes the geometry of the deformable iris filter cavity for causing a change in the frequency of a signal being filtered by the filter.

In one aspect, the method described above can be one part of a method for constructing arrays of tunable iris filters and phase shifters for mm-wave sensing applications, such as for radar system.

For a further understanding of the nature and advantages of the invention, reference should be made to the following description taken in conjunction with the accompanying drawings.

BRIEF DESCRIPTION OF THE DRAWINGS

FIG. 3 is graph of the simulation results for the device of FIG. 1. FIG. 3*a* shows the insertion loss and FIG. 3*b* shows the return loss for the tunable iris filter with membrane deflection varying from −150 μm to +150 μm.

FIG. 6*a* is graph of the insertion loss and FIG. 6*b* is a graph of the return loss of a tunable two-pole 94 GHz-96.6 GHz filter.

DETAILED DESCRIPTION OF THE INVENTION

The embodiments of the present invention are directed towards tunable waveguide-based iris filters and phase shifters using deformable membranes. The devices in accordance with the embodiments of the present invention can be applied in W-band as well as other spectrums. Such filters can function as continuous microwave tunable filter that can operate at 95 GHz. As used herein, the W-band of the microwave part of the electromagnetic spectrum ranges from 75 to 111 GHz. It sits above the US IEEE designated V band (50-75 GHz) in frequency. It overlaps with the NATO designated M band (60-100 GHz). The W band is used for millimeter wave radar and other scientific systems. For example, the atmospheric window at 94 GHz is used for imaging mm-wave radar applications in astronomy, defense and security applications. The inventive tunable filters and phase shifters can be manufactured using plastic hot-embossing technologies, such as those used by the inventors herein (e.g., see F. Sammoura et al., *The 13th International Conference on Solid-State Sensors, Actuators and Microsystems*, pp. 1067-1070, Seoul, Korea, Jun. 5-9, 2005). Some embodiments of the present invention provide plastic, W-band MEMS tunable filters and phase shifters that have built-in deformable membranes. Prototypical filters were fabricated using a MEMS-based process including a plastic micro embossing process and a gold electroplating process. In one prototype, two movable membranes of 1.6 mm in diameter were designed as parts of a two-cavity iris filter to actively change the cavity geometry for frequency turning. Prototype filters were fabricated and measured having a bandwidth of 4.05 GHz centered at 94.79 GHz with a minimum insertion loss of 2.37 dB and return loss better than 15 dB. In one implementation, a total of 2.59 GHz center frequency shift was achieved when membranes deflected from −50 μm to +150 μm.

The tunable filters in accordance with the embodiments of the present invention can also function as phase shifters. In one specific implementation, a total phase shift of 110° at 95 GHz was achieved upon deflecting the membrane from −50 μm to 150 μm with an addition of 1.11 dB of insertion loss.

Tunable Filter Design and Modeling

Figure 1:
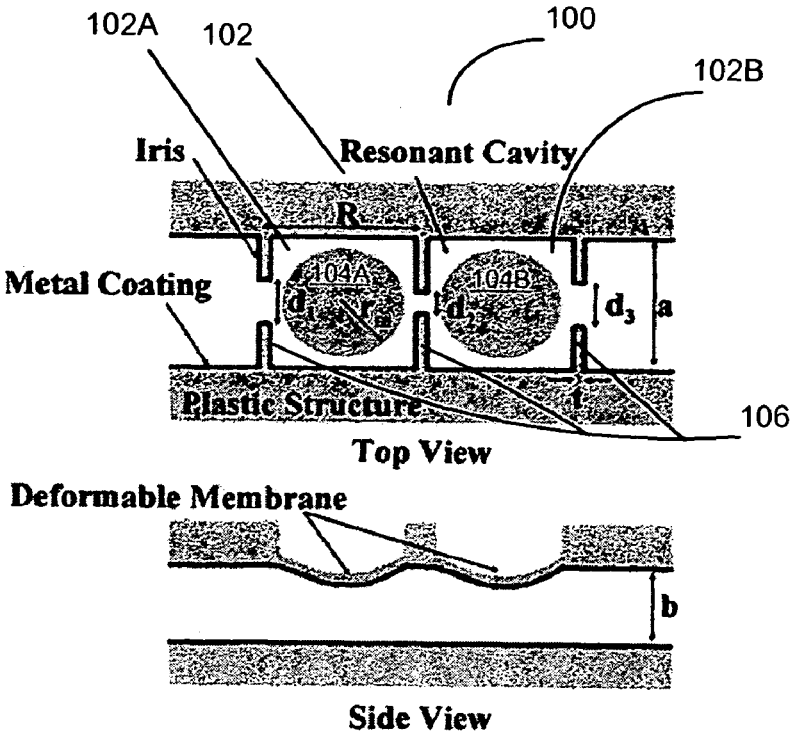
FIG. 1 is an exemplary schematic diagram of a two-cavity iris-filter and phase shifter with two deformable circular membranes on the top surface of each cavity in accordance with one embodiment of the present invention.

FIG. 1 shows an exemplary schematic diagram 100 of a tunable filter 102 having a two-cavity iris-filter arrangement 102A and 102B with two deformable circular membranes 104A, and 104B on the top surface of each cavity in accordance with one embodiments of the present invention. It should be realized that the tunable filter 102 in accordance with the embodiment of the present invention is not limited to any particular configuration. For example, shown in FIG. 1, are two tunable iris cavities (102A, and 102B) that are adjacent to one-another, however, the number of tunable filter cavities can be as small as one and as large as necessary. Each tunable filter cavity (102A and 102B) has an iris 106 at its inlet and its outlet. The device 102 can be made of a plastic structure and its internal walls electroplated with metallic layer. In one embodiment, the internal walls are electroplated with a 3-μm thick gold layer. In FIG. 1, "a" and "b" are the width and height of the rectangular waveguide, respectively; $r_m$ is the radius of the diaphragm; R is the length of the resonant cavity; $d_1$, $d_2$, $d_3$, are iris gaps and t is the iris thickness. In the prototype design of FIG. 1, the deformable diaphragms 104A and 104B are controlled by an external pump. However it should be realized that the deformable diaphragm can also be movable by using built-in MEMS actuators. Alternatively, the deformable or movable diaphragm can be a MEMS piezoelectric membrane that can be moved under the influence of appropriate levels of voltage or current.

Figure 2:
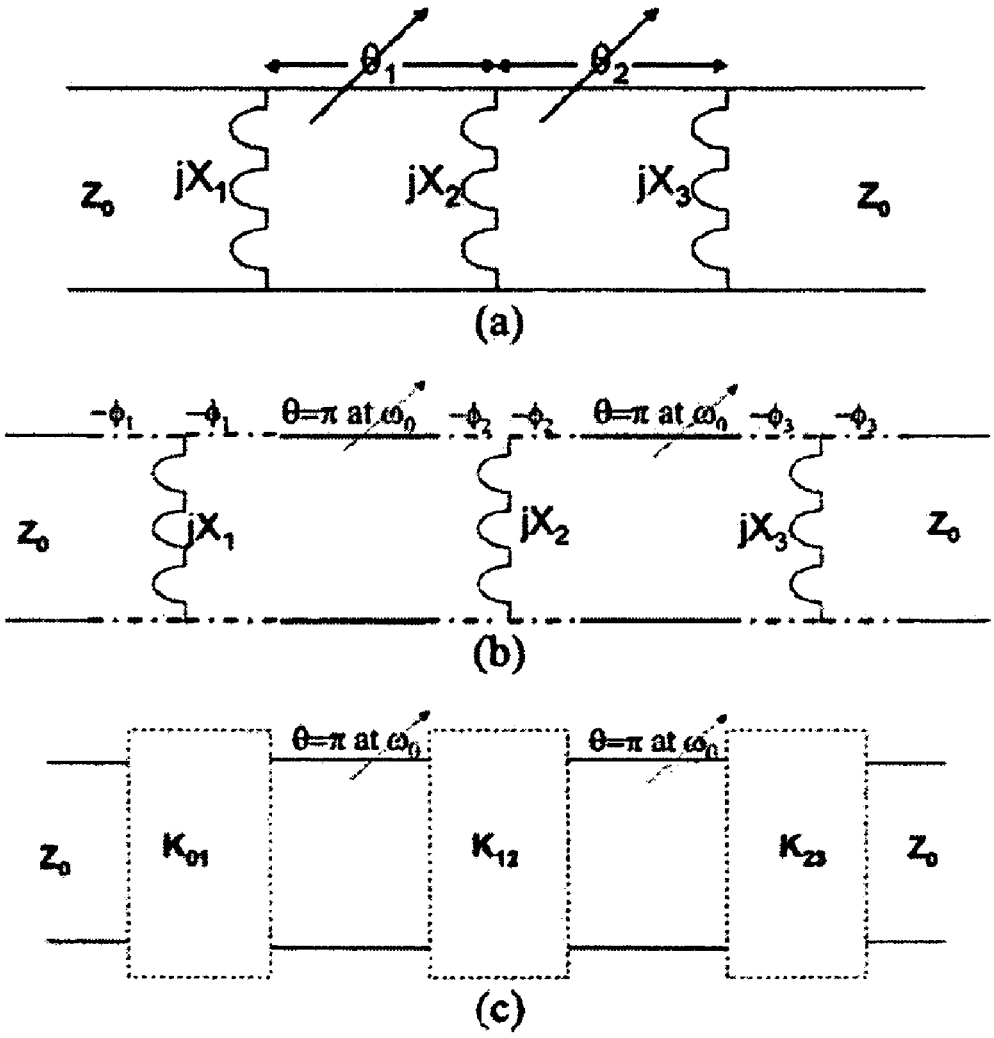
FIG. 2*a* is an exemplary equivalent transmission line circuit for the device of FIG. 1.
FIG. 2*b* is an exemplary transmission line equivalent circuit with negative-length sections forming impedance inverters.
FIG. 2*c* is an exemplary equivalent circuit using inverters and $\lambda/2$ resonators.

FIG. 2*a* is an exemplary transmission line model for the tunable filter of FIG. 1 where the inductive metal planes are modeled as parallel inductive shunts of impedance, X, and the resonant cavities are modeled as transmission lines of electrical length $\theta_1$ and $\theta_2$ respectively. In this 2-cavity design, $\theta_1$ equals $\theta_2$ and $X_1$ equals $X_3$ due to symmetry ($d_1=d_3$), however, it should be realized that the embodiments of the present invention can have cavities of same or different dimensions. The deflection of the membrane changes the electrical lengths of the transmission lines to tune the center frequency of the filter. In one theoretical model, the thickness of the iris can be neglected and the relationship between the iris gaps and the inductive susceptance can be given as (e.g., see Robert E. Collin, *Foundations of Microwave Engineering,* 2nd Edition, (McGraw Hill, 1992)):

$$B = \frac{1}{X} = \frac{2\pi}{\beta a}\cot^2\frac{\pi d}{2a}\left(1 + \frac{a\gamma - 3\pi}{4\pi}\sin^2\frac{\pi d}{a}\right) \quad (1)$$

where $\beta=[k_0^2-(\pi/a)^2]^{1/2}$, $\gamma-[(3\pi/a)^2-k_0^2]^{1/2}$, and $k_0$ is the wave number of the material filling the waveguide. FIG. 2*b* is a transmission line equivalent model with negative-length sections forming impedance inverters between transmission lines of electrical length $\pi$. FIG. 2*c* is an equivalent circuit using K-type inverters and $\lambda/2$ resonators ($\theta=\pi$ at $\omega_0$). For an impedance inverter constructed using an inductive load shunted between two transmission lines of negative electrical length $\phi$, the impedance inverter value, K, and angle, $\phi$, are given as (e.g., see David M. Pozar, *Microwave Engineering*, (John Wiley & sons, 1997)):

$$K=Z_0\tan(\phi/2) \quad (2)$$

$$\phi=\tan^{-1}(2X/Z_0) \quad (3)$$

where $Z_0$ is the line impedance.

Iris Filter Design

The insertion loss method with binomial coefficients can be used to design the flat, passband response for a 2-pole filter (e.g., see David M. Pozar, *Microwave Engineering*, (John Wiley & sons, 1997)):

$$P_{LR}=1+(\omega/\omega_c)^{2N} \quad (4)$$

where N is the order of the filter (2 in this case) and $\omega_c$ is the cutoff frequency for the transformed low pass model.

For the exemplary device of FIG. 1, a 2-cavity resonant filter is chosen such that under the same membrane deformation in both cavities, equal shift in resonant frequency of each cavity is achieved due to symmetry. For higher order filters, the membrane deflection in the cavities is synchronized such that filter response is preserved. The K values for the 2-cavity filter can be calculated using the following equations (e.g. see Robert E. Collin, *Foundations of Microwave Engineering,* 2nd Edition, (McGraw Hill, 1992)):

$$\frac{K_{01}}{Z_0} = \frac{K_{23}}{Z_0} = \sqrt{\frac{\pi\Delta}{2g_1}} \quad (5)$$

$$\frac{K_{12}}{Z_0} = \frac{\pi\Delta}{2}\frac{1}{\sqrt{g_1 g_2}} \quad (6)$$

where $\Delta=2(\lambda_1-\lambda_2)/(\lambda_1+\lambda_1)$, $\lambda_1$ and $\lambda_2$ are the lower and upper cutoff wavelengths in waveguide respectively, and $g_1=g_2=\sqrt{2}$ for the maximally flat 2-pole filter design. After specifying the lower and upper cut-off frequencies, Eq. (5) and (6) are used to calculate the impedance inverter values. Afterwards, Eq. (2) and (3) can be used to calculate the negative electrical length of the inverter and the inductive shunt value, respectively. The iris gaps are derived from Eq. (1).

Tunable Iris Filter Simulation

The effect of iris thickness on the magnitudes of center frequency and bandwidth was analyzed using the High Frequency Structure Simulator (HFSS). HFSS is a finite-element electromagnetic simulator for the design and optimization of arbitrarily-shaped, passive three-dimensional structures. HFSS is commercially available from the Ansoft corporation. Based on the results of the simulations, as the iris thickness increases, the bandwidth decreases and the center frequency increases while the penalty is the increase of return loss. In one simulation, the iris thickness was set to be 300 μm as that represented the smallest dimension that could be realized in the prototype example using precision machining to make the mold insert. The width and the height of the waveguide were 2.54 mm and 1.27 mm respectively. To realize the filter, the resonant length R and the iris gaps $d_1$ and $d_2$ were calculated as 1.95 mm, 1.25 mm, and 0.874 mm, respectively. Based on these values, the simulated center frequency of the prototype filter was 94.38 GHz and its bandwidth was 4.2 GHz with a minimum insertion loss of 0 dB and a return loss better than 15 dB over the entire band. The various parameters of the deformable membrane were also simulated using HFSS. It is preferable to have the membrane diameter be as big as possible to have large frequency tuning effects. As a result, the membrane diameter was chosen to be 1.6 mm to fit into the resonant cavity. Simulation results in FIG. 3 show the return loss and insertion loss curves when the membrane deflected from −150 μm to 150 μm where the minus sign is defined as the membrane is deflected downward as shown in FIG. 1(*b*). Table 1 summarizes the simulation results of various parameters when the membrane deflects from −150 to 150 μm and a total center frequency shift of 4 GHz is predicted, with no additional insertion loss and minimal bandwidth distortion.

TABLE 1

Simulated filter parameters

| Deflection [μm] | −150 | −50 | 0 | +50 | +150 |
|---|---|---|---|---|---|
| $f_{c1}$ [GHz] | 90.00 | 91.90 | 92.30 | 93.00 | 94.15 |
| $f_{c2}$ [GHz] | 94.00 | 95.90 | 96.50 | 97.05 | 98.05 |
| $f_c$ [GHz] | 91.98 | 93.88 | 94.38 | 95.00 | 96.08 |
| I.L. [dB] | 0.00 | 0.00 | 0.60 | 0.01 | 0.02 |
| BW [GHz] | 4.0 | 4.0 | 4.2 | 4.05 | 3.9 |
| % BW | 4.34 | 4.26 | 4.45 | 4.26 | 4.06 |

Fabrication Process

Figure 4:
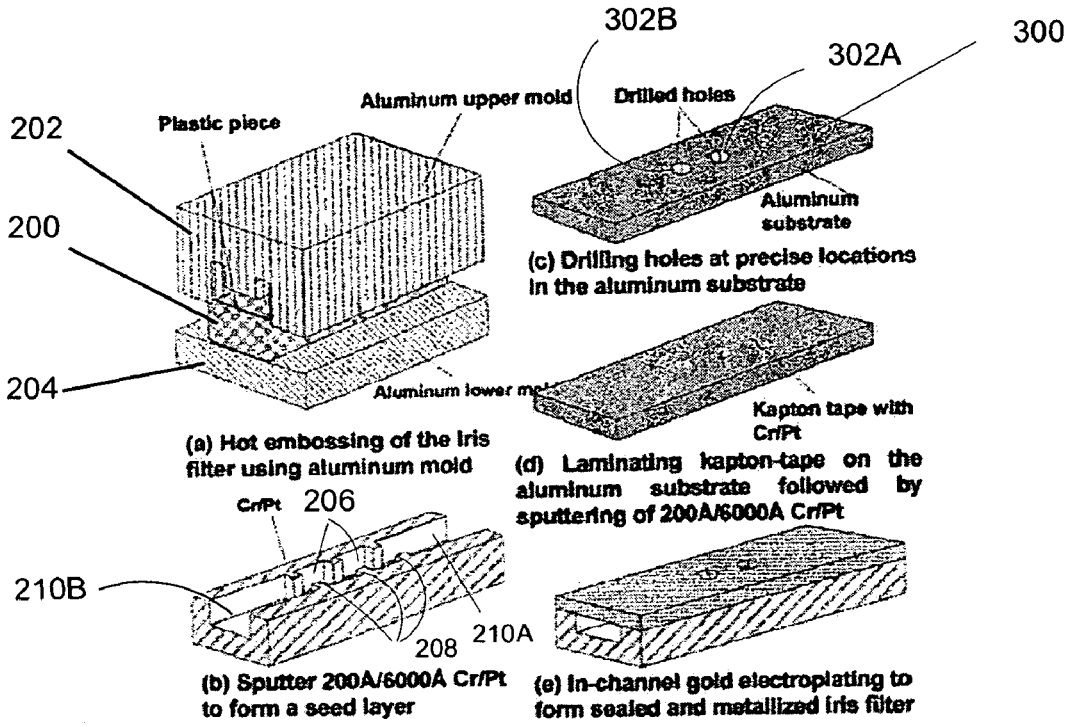
FIG. 4 is an exemplary diagram of the fabrication process for a tunable waveguide iris filter and phase shifter in accordance with one embodiment of the present invention.

One fabrication process in accordance with the embodiments of the present invention is shown in FIG. 4 and described below. Further details of the fabrication process are provided in F. Sammoura et al., *Proceedings of* 18*th IEEE Micro Electro Mechanical Systems Conference*, pp. 167-170, Miami, Fla., Jan. 30-Feb. 3, 2005.

As is shown in FIG. 4*a*, first a plastic piece 200 is formed by a hot embossing process using dies 202 and 204. Alternatively, instead of a hot embossing process an injection molding process can be used to form the piece 200. The hot embossing process forms a plastic piece as shown in FIG. 4*b*, which is a first part of a two-part assembly. FIG. 4*b* shows the lower part of the resonant cavities 206, the iris structures 208 and waveguide structures 210A and 210B formed adjacent to the lower cavity portions 206. Then, at FIG. 4*b*, a metallic seed layer (e.g., a 200 Å/6000 Å layer of chromium/platinum) is sputtered on the plastic piece. The Cr/Pt seed layer is preferred since the Cr/Pt layer has a good adhesion with the plastic piece and the pt does not form an oxide layer. Other seed layers such as Ti/Pt, Cr/Au, Cr/Ag, and other similar seed layers may also be used. Then to form the upper portion of the tunable filter, or the second part of the two-part assembly, a substrate 300 is formed to have two 1.6 mm in diameter holes 302A-B, as shown in FIG. 4*c*. The substrate can be made of aluminum. The substrate can also be made of other suitable metallic or plastic materials. Then, a 25 μm-thick kapton tape is bonded on the substrate to form the deformable membrane in the prototype device, shown in FIG. 4*d*. Then another metallic seed layer (e.g., a seed layer of 100 Å/1000 Å Cr/Pt) is sputtered on the Kapton tape (Polyimide tape), similar to the seed layer on the internal parts of the plastic iris filter. Following the assembly of the substrate 300 with the plastic part 200, a gold layer is selectively electroplated to seal and metallize the tunable iris filters, as shown in FIG. 4*e*. The thickness of the gold layer can be between about 3-8 μm thick. Alternatively, instead of the gold layer other high conductivity metals such as copper may also be used. The manufacturing process described above allows for simple manufacturing of several or several arrays of deformable cavities in an integrated process.

In the manufacture of the deformable iris filter cavity substrate described above, any plastic material may be used. Plastic materials that may be used include, but are not limited to Topas©COC, PVC, Polycarbonate, Polypropylene, and so on. In connection with the choice of plastic material, a plastic material is preferred that has a similar or a same thermal expansion coefficient as the top (e.g. membrane supporting) portion. The deformable membrane can also be made from any other suitable and soft material that is easily deflectable. Such membrane materials include, but are not limited to polyimide (e.g., Kapton tape as used in the examples), nitride, acrylic, rubber, and so on.

EXAMPLES

Figure 5:
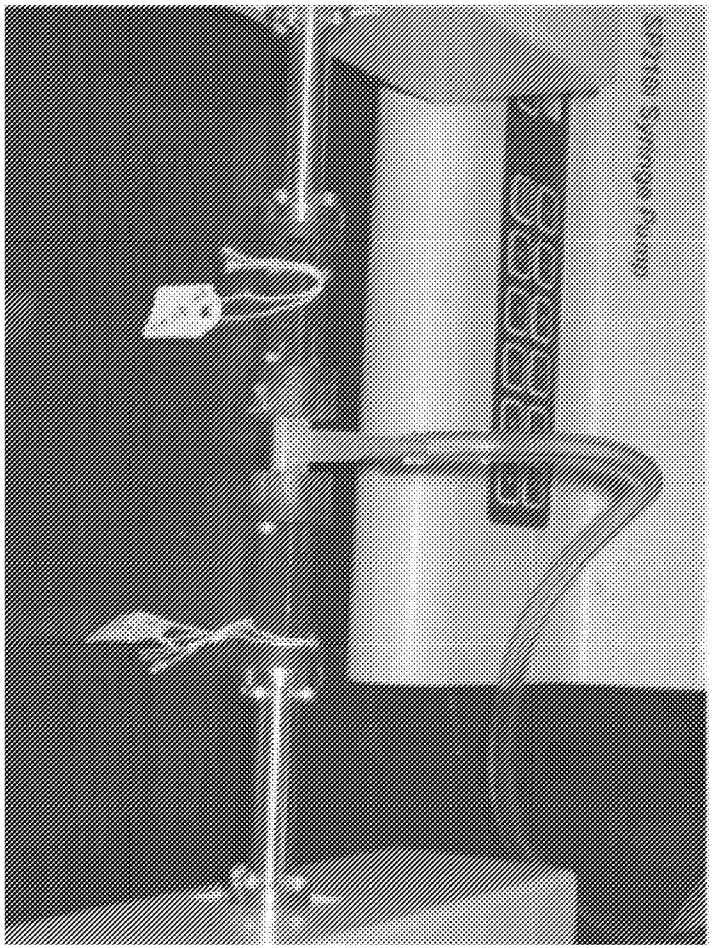
FIG. 5 is a photograph of a plastic tunable iris filter and phase shifter device shown in an experimental setup.

FIG. 5 shows a photograph of a plastic tunable iris filter with integrated flanges, pressure tube and connectors to a network analyzer. The pressure tube is used to deform the membranes of the tunable iris filter.

For the prototypical tunable filter in accordance with the embodiments of the present invention, the tunable filter scattering parameters $s_{11}$ (return loss) and $s_{21}$ (insertion loss) were measured from 75 GHz to 110 GHz using an Anritsu ME7808B network analyzer. The membrane deflection was first characterized under a probe station. When vacuum was applied, the deflection of the membrane was about +150 μm. When a pressure of 0.25 atm was applied, membrane deflection of −50 μm was expected. The deflection data were gathered under the microscope using the focusing/defocusing method. The experimental insertion loss data in FIG. 6(*a*) shows an insertion loss of 2.36 dB, 2.37 dB, and 2.4 dB when the membrane deflections are +150, 0 and −50 μm, respectively. The return loss shown is FIG. 6(*b*) is better than 15 dB and the center frequency drops from 96.59 GHz to 94.79 GHz and to 94.00 GHz. Therefore, the tuning range is 2.76% of the center frequency. Table II below summarizes the tunable filter performance. The simulated data at zero deflection shows a bandwidth of 4.2 GHz centered at 94.38 GHz, while the measured data shows a bandwidth of 4.05 GHz centered at 94.79 GHz. The extra insertion loss can be attributed to the gap between the devices under test (DUT) and the network analyzer adaptors.

TABLE II

Filter performance due to membrane deflection

| Deflection [μm] | −50 | 0 | +150 |
|---|---|---|---|
| $f_{c1}$ [GHz] | 92.00 | 92.79 | 94.48 |
| $f_{c2}$ [GHz] | 96.05 | 96.84 | 98.75 |
| $f_c$ [GHz] | 94.00 | 94.79 | 96.59 |
| I.L. [dB] | 2.4 | 2.37 | 2.36 |
| BW [GHz] | 4.05 | 4.05 | 4.27 |
| % BW | 4.31 | 4.27 | 4.42 |

Plastic Phase Shifters

Figure 7:
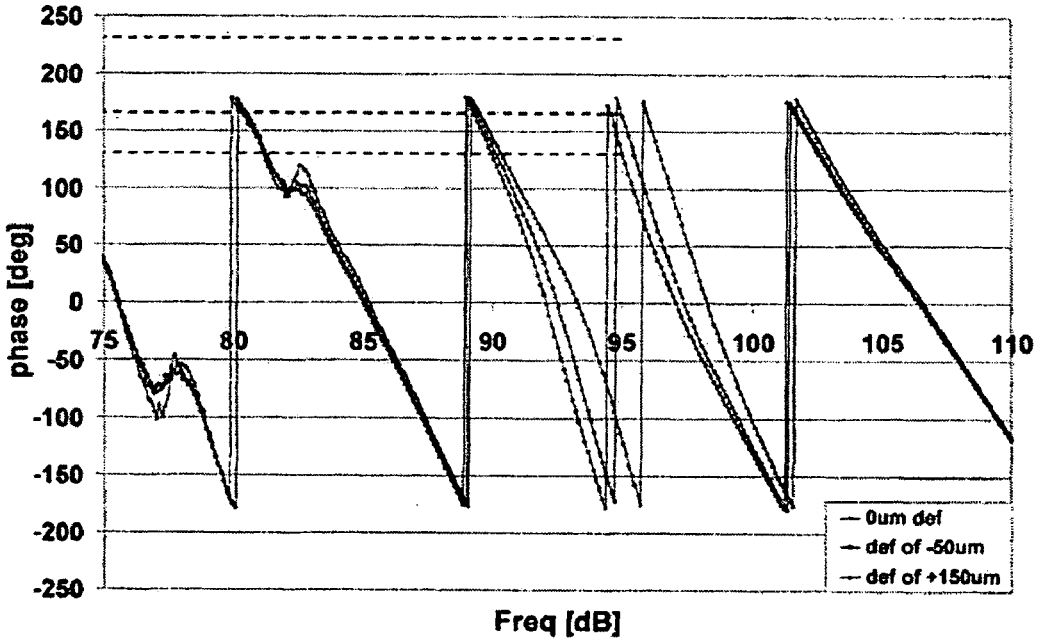
FIG. 7 is a graph of the measured phase shift using a tunable two-pole iris filter as a phase shifter.

The tunable filter in accordance with the embodiments of the present invention can also be used as a phase shifter. FIG. 7 is a graph of the measured phase from 75 GHz to 110 GHz. With no deflection, each cavity resonated at the center frequency, $f_{01}$. As the membrane defects, the center frequency of each cavity changes and thus each cavity can appear as a pure inductor or a pure capacity at $f_{01}$. As such, waves within the pass band would experience a phase shift. Table III below summarizes the measured phase data in addition to the insertion loss at 95 GHz. A total phase shift of 110° at 95 GHz was achieved upon deflecting the membrane from −50 μm to 150 μm with an addition of 1.11 dB of insertion loss.

TABLE III

Phase shifter performance due to Membrane deflection

| Deflection [μm] | I.L. [dB] | ϕ [deg] | Δϕ [deg] |
|---|---|---|---|
| −50 | 2.9 | 130 | 0 |
| 0 | 2.37 | 164 | 34 |
| 150 | 3.48 | 240 | 110 |

As a phase shifter the tunable iris filter cavity in accordance with the embodiments of the present invention has utility as a part of an electronically scanned radar array, for example such as those used in vehicles to detect objects that are in the vicinity of the vehicle. Contrary to dish or slotted array antennas, which use physical shape and direction to form and steer the beam, phased array antennas utilize the interference between multiple radiating elements to achieve beam forming and beam steering. By electronically adjusting the signal each element radiates, the combined radiation pattern can be scanned and shaped at high speed. Phase shifters are critical elements for electronically scanned phased array antennas, and typically represent a significant amount of the cost of producing an antenna array. Phase shifters are the devices in an electronically scanned array that allow the antenna beam to be steered in the desired direction without physically repositioning the antenna. There is significant demand in the wireless and microwave industries for affordable phase shifters that can reduce the cost of an electronically scanned antenna system and allow them to be deployed more widely. Additionally, phase shifters provide an elegant way of linearizing amplifiers for such applications as cellular base stations. The phase shifters when manufactured in accordance with the embodiments of the present invention can provide for significant cost savings, helping to keep down the costs for the entire electronically scanned array.

All publications and descriptions mentioned above are herein incorporated by reference in their entirety for all purposes. None is admitted to be prior art.

The above description is illustrative and is not restrictive, and as it will become apparent to those skilled in the art upon review of the disclosure, the present invention may be embodied in other specific forms without departing from the essential characteristics thereof. These other embodiments are intended to be included within the scope of the present invention. The scope of the invention should, therefore, be determined not with reference to the above description, but instead should be determined with reference to the following and pending claims along with their full scope or equivalents.

What is claimed is:

1. A tunable iris filter, comprising:

one or more iris filter cavities each having an inlet and an outlet; and one or more multi-layered deformable membranes disposed on the surfaces of each of the iris filter cavities, each multi-layered deformable membrane comprising a layer of flexible dielectric material and one or more submicron metal layers;

whereby movement of the one or more multi-layered deformable membranes changes the geometry of the iris filter cavities for causing a change in the frequency of a signal being filtered by the filter.

2. The apparatus of claim 1 having more than two operatively coupled cavities and multi-layered deformable membranes.

3. The apparatus of claim 1 wherein the one or more iris cavities have a rectangular cross section.

4. The apparatus of claim 1 further comprising means for moving the one or more multi-layered deformable membranes while operating the apparatus so as to actively tune the filter.

5. A phase shifter, comprising:

one or more iris filter cavities each having an inlet and an outlet; and one or more multi-layered deformable membranes disposed on the surfaces of each of the iris filter cavities, each multi-layered deformable membrane comprising a layer of flexible dielectric material and one or more submicron metal layers;

whereby movement of the one or more multi-layered deformable membranes changes the geometry of the iris filter cavities for causing a change in the phase of a signal being filtered by the filter.

6. An actively tunable W-band iris filter, comprising:

a first part including a first portion of a deformable iris filter cavity having an inlet and an outlet;

a second part operatively coupled with said first part and including a second portion of the deformable iris filter cavity having a multi-layered deformable membrane operatively coupled with the first portion of the deformable iris filter cavity, said multi-layered deformable membrane comprising a layer of flexible dielectric material and one or more submicron metal layers; said first portion and said second portion together forming the deformable iris filter cavity of the tunable W-band iris filter; and means for moving the multi-layered deformable membrane, whereby movement of the multi-layered deformable membrane changes the geometry of the deformable iris filter cavity for causing a change in the frequency of a signal being filtered by the filter.

7. The apparatus of claim 6 wherein said means for moving the multi-layered deformable membrane is configured for causing a shift in the phase of a signal being filtered by the filter.

8. The apparatus of claim 6 wherein said first part is made of a plastic material having an internal surface, and a metal coating disposed on the internal surface.

9. The apparatus of claim 8 wherein said metal coating comprises gold.

10. The apparatus of claim 8 wherein said metal coating is formed by an electroplating process on said internal surface of said first portion.

11. The apparatus of claim 6 wherein the multi- layered deformable membrane is more deformable than the first part of the deformable iris filter cavity of the tunable W-band iris filter.

12. The apparatus of claim 6 wherein said multi- layered deformable membrane is dimensioned to fit into the first portion of the deformable iris filter cavity.

13. The apparatus of claim 6 wherein said means for moving the multi-layered deformable membrane include means for applying a force to the membrane so as to cause a movement of the membrane.

* * * * *